US005838220A

United States Patent [19]

Hagberg

[11] Patent Number: 5,838,220

[45] Date of Patent: Nov. 17, 1998

[54] TOROIDAL TRANSFORMER WITH SPACE SAVING INSULATION AND METHOD FOR INSULATING A WINDING OF A TOROIDAL TRANSFORMER

[75] Inventor: Christer Hagberg, Katunayake, Sri Lanka

[73] Assignee: Toroids International Hong Kong Ltd, King's Road, Hong Kong

[21] Appl. No.: 895,577

[22] Filed: Jul. 16, 1997

[51] Int. Cl.[6] ..... H01F 27/28; H01F 27/30

[52] U.S. Cl. ..... 336/206; 336/209; 336/229

[58] Field of Search ..... 336/229, 206, 336/209

[56] References Cited

U.S. PATENT DOCUMENTS 5,179,776 1/1993 Boetnitz et al. ..... 336/206
5,488,344 1/1996 Bisbee et al. ..... 336/206

FOREIGN PATENT DOCUMENTS 4-42514 A 2/1992 Japan ..... 336/206
6-5437 A 1/1994 Japan ..... 336/229

*Primary Examiner*—Renee S. Leubke
*Assistant Examiner*—Anh Mai

[57] ABSTRACT

Toroidal transformers and other toroidal magnetic components need insulation between separate windings. International safety standards specify minimum requirements for both total insulation thickness and number of layers of insulation. The safety requirements can be met by a toroidal transformer insulation method and toroidal transformer having, in combination, a wide sheet of insulation material covering the outside perimeter and the top and bottom radial surfaces of a winding but not entering into the center hole, and wrapping with a narrow strip of insulation material for covering the entire winding and the wide sheet of insulation material. Because the wide sheet adds insulation on the outside perimeter of the winding, which is larger then the inside perimeter of the center hole, the outer wrapping with the narrow strip need only provide the insulation actually required on the inside perimeter of the center hole. This insulation method thus avoids unnecessary build up of insulation in the center hole of the toroidal component, and thereby saves space for toroidal winding heads and/or shuttles for wire and insulation.

8 Claims, 3 Drawing Sheets

TOROIDAL TRANSFORMER WITH SPACE SAVING INSULATION AND METHOD FOR INSULATING A WINDING OF A TOROIDAL TRANSFORMER

BACKGROUND OF THE INVENTION

The present invention relates to a toroidal transformer with insulation between windings, and to a method of insulating a winding of a toroidal transformer.

Toroidal transformers are based on magnetic cores of toroidal shape, usually made by coiling a strip of transformer sheet to form a so-called "tape wound core." Multiple windings are threaded through the center hole of the core and distributed evenly along the circumference of the toroidal core. Insulation is provided between the toroidal core and the first winding, between successive windings, and on the outside of the last winding. The core insulation is usually made (1) by curing an insulating layer of plastic or ceramic material on the outer surface of the core, (2) by fitting plastic caps on the top and bottom of the core, or (3) by winding a narrow strip of plastic material in overlapping fashion through the center hole in the toroid. The two first core insulation methods are not suitable for insulation arranged on a winding, because a winding cannot withstand high curing temperature, and the size and shapes of windings are so variable that standardized caps cannot be used. Insulation on windings is thus made almost exclusively by winding a narrow strip of plastic material through the center of the toroid in overlapping fashion.

Generally, all transformers must meet international safety codes, such as those issued by Underwriters Laboratories in the U.S.A., or the International Electrotechnical Commission in Switzerland. These safety codes specify insulation data for dry type plastic-based insulation used between primary and secondary windings in toroidal power transformers, such as the minimum total thickness of the insulation, minimum number of layers of plastic film, and minimum creep distance along the insulation material. For both technical and economical reasons, it is preferable to select core dimensions such that the inner diameter of the center hole in the primary winding is about half as large as the outer diameter. When conventional wrapping with a plastic strip is used as insulation, the outside periphery must have a sufficient number of layers to meet the safety code, but the inner periphery will then get about twice the required amount of insulation, because of the smaller diameter inside the center hole. This means that the insulation takes up a lot more space in the center hole than required by insulation requirements, so the net center hole diameter is reduced. The diameter of the free opening in the center hole must be large enough to allow a winding head with stored wire or insulation to rotate freely inside the center hole, so the final size of the center hole determines the minimum mechanical size of the transformer. Excessive space taken up by the insulation in the center hole of the winding of a small toroidal transformer is accordingly a main limiting factor determining the size and the cost of small toroidal transformers.

U.S. Pat. No. 5,488,344 to Bisbee et al. describes a different method for insulating windings in toroidal transformers. Multiple pre-formed sections of electrical insulating material are fitted in overlapping fashion along the top and bottom of the outer and inner periphery of the primary winding, and the next winding is wound directly on the overlapping pre-forms. The suggested material for the pre-forms is crepe paper, and it is assumed that the crepe paper pre-forms will be compacted by the subsequent winding to be essentially free from voids. Insulation based on crepe paper requires vacuum impregnation to meet standards, and vacuum impregnation is not an economically suitable process for small dry type toroidal transformers. It would be impractical and excessively expensive to use pre-forms made of plastic instead of crepe paper for small toroidal transformers. A large number of winding sizes would be involved, and individual windings on small toroidal transformers differ in shape even when they are nominally identical. The composite curvature of windings in small toroidal transformers would be so sharp that it is unlikely that a plastic pre-form could bend to conform to the actual shape of an underlying winding unless it closely matches the actual shape of the winding, so a large number of pre-form sizes, and a corresponding large number of pre-form tooling would be required.

SUMMARY OF THE INVENTION

A primary object of the present invention is to provide a method for minimizing the amount of insulation material in the center hole of a toroidal winding in a toroidal transformer or other toroidal magnetic device.

A further object of the invention is to provide a method for insulating windings in small toroidal transformers that provides more free space in the center hole of the transformer than conventional transformer insulation methods.

Another object of the invention is to provide a new and inexpensive method for providing a space saving insulation for windings in small toroidal transformers.

A still further object of the invention is to provide a space saving insulation for small toroidal transformers that does not require any new or unusual tools or machinery for its application.

Finally, it is a object of the invention to provide a toroidal transformer with the above-described spacing saving insulation and therefore a transformer having the resulting advantages and improved characteristics thereof.

Objects of the invention are achieved by a method for insulating a winding on a toroidal transformer, which comprises the steps of providing a toroidal magnetic device with a winding having a center hole, an outer periphery, an axial extension, and upper and lower surfaces with radial extensions; providing a sheet of insulating material having edges defining a width larger than the axial extension; wrapping the sheet of insulating material along the outer periphery; folding the edges of the sheet onto the upper and lower surfaces; providing a narrow strip of insulating material; and wrapping the strip of insulating material through the center hole to cover the winding and the sheet of insulating material.

Objects of the invention are also achieved by a toroidal transformer comprising (a) a winding with a center hole, an outer periphery, an axial extension, and upper and lower radial extensions between the outer periphery and the center hole; and (b) electrical insulation applied on the winding, wherein the insulation includes (i) a sheet of insulating material having edges defining a width larger than the axial extension wrapped around the outer periphery and with edges folded onto the upper and lower radial extensions and (ii) a narrow strip of insulating material wrapped through the center hole and covering the winding and the sheet of insulating material.

Additional objects and advantages of the invention will be set forth in part in the description which follows, and, in part, will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF PREFERRED EMBODIMENT

Reference will now be made in detail to a preferred embodiment of the invention, examples of which are illustrated in the accompanying drawings.

Figure 1:
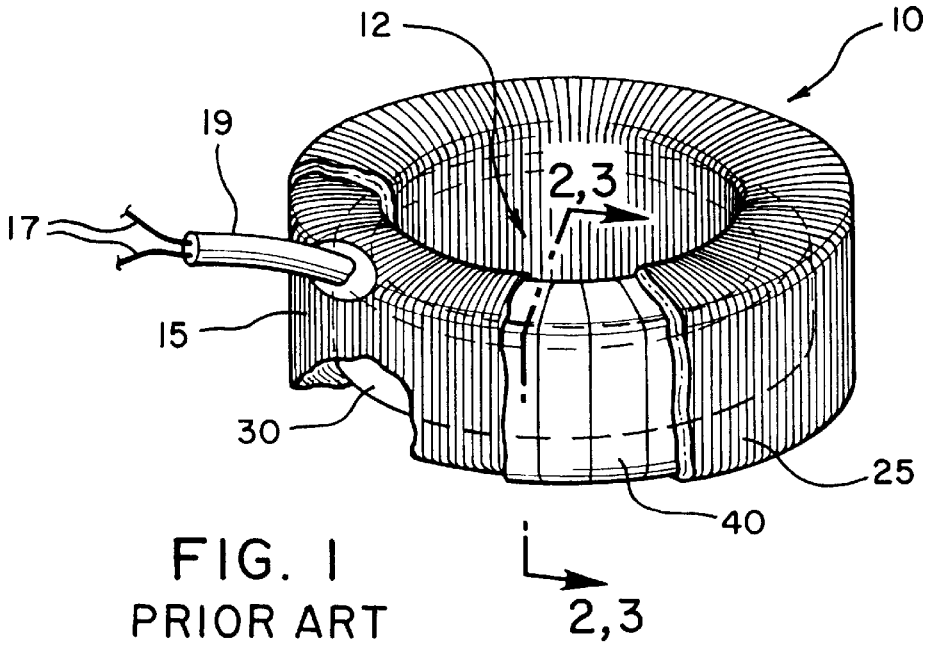
FIG. 1 PRIOR ART
FIG. 1 is a perspective view of a typical toroidal power transformer, partly in section.
Figure 2:
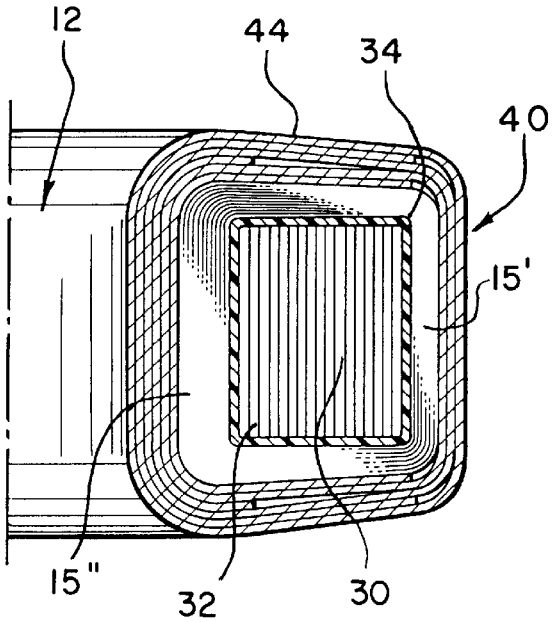
FIG. 2 PRIOR ART
FIG. 2 is a sectional view, taken along line 2—2 in FIG. 1, illustrating a prior art form of insulation for a primary winding in a toroidal power transformer, with the thickness of the insulation exaggerated for the purpose of clarity.

FIG. 1 is a perspective view of a typical toroidal power transformer 10. Transformer 10 comprises a core 30 with insulation 34 (FIG. 2), a primary winding 15 with lead wires 17 in an insulating sleeve 19, a secondary winding 25, a center hole 12, and electrical insulation 40 between the primary winding 15 and the secondary winding 25. In some cases, there will be more than one primary winding and/or secondary winding, and there may be additional insulation between separate primary windings as well as between separate secondary windings. The core 30 is usually made by coiling a strip 32 of transformer sheet and insulation 34 provided thereon, as shown in FIG. 2, to form the so-called "tape wound core."

The primary winding 15 must be wrapped around the cross section of the core 30 and distributed along the circumference of the core 30. This is done in a toroidal winding machine by threading a circular winding head with a magazine for storing magnet wire through the center hole of the core 30, then storing insulated copper wire on the magazine, and finally rotating the winding head around the core 30 through the center hole while peeling copper wire off the magazine. The core 30 is rotated slowly about the toroidal axis during winding, so the wire is distributed along the circumference of the core 30.

The insulation 40 in small dry type toroidal transformers is almost always made of plastic film, which in the prior art was applied by wrapping several layers of thin and narrow plastic film strip on top of the primary winding 15 by using a toroidal wrapping machine working basically the same way as a toroidal winding machine as described above. The strips are overlapped laterally to provide creep insulation across the strip.

One or more secondary windings 25 are wound on top of the insulation 40 in the same way as the primary winding 15 was wound on the core 30. An outer layer of insulation (not shown) is usually added on top of the last secondary winding to protect the secondary windings, unless the toroidal transformer 10 is potted in plastic as a final production step.

The main electrical insulation 40 between the primary winding 15 and the secondary winding 25 in a toroidal transformer 10 is critical for the safe operation of the transformer. It must, accordingly, meet strict safety requirements. The insulation material of choice for toroidal transformers is polyethylene terephtalate (PEPT) film, such as DuPont MYLAR®. Basic requirements for this type of insulation are in summary as follows:

| | |
|---|---|
| Transformer size > 100 VA: | Minimum three layers of PEPT film. Total thickness min. 0.3 mm. |
| Transformer size 25–100 VA: | Minimum three layers of PEPT film. Total thickness min. 0.2 mm. |
| Transformer size < 25 VA: | Minimum three layers of PEPT film. Total thickness min. 0.1 mm. |

These requirements for the main electrical insulation 40 in a toroidal transformer have conventionally been achieved by wrapping the primary winding with a 13 mm wide and 0.05 mm thick strip of PEPT plastic material. In large transformers (>100 VA), three wraps of such plastic strip are applied on the primary winding 15, with consecutive strips overlapping each other 50% on the outer periphery of the primary winding. This provides six layers times 0.05 mm for a total thickness of 0.3 mm on the outer periphery, as required. For intermediate sizes (25–100 VA), a total insulation thickness of 0.2 mm and four layers of film is achieved by using two wraps of 50% overlapping strip. For small transformers (<25 VA), the required three layers of plastic film are achieved by using one wrap of 67% overlapping PEPT strip. The total insulation thickness is in this case 0.15 mm, which is more than the required minimum of 0.1 mm, but it is not practical to use film thickness less than 0.05 mm.

The outside diameter of a toroid, by definition, is larger than the inside diameter. Typically, the outside diameter of the primary winding 15 in a small toroidal transformer is about twice as large as the diameter of the center hole 12. The build-ups of both the primary winding 15 and the insulation 40 will, accordingly, be larger on the inside of a toroidal transformer than on the outside. This is illustrated in FIG. 2, which is a cross-sectional view of the transformer 10 of FIG. 1, taken along line 2—2 in FIG. 1. The amount of copper wire is the same on the inside part 15" and on the outside part 15' of the primary winding, so the radial thickness of the inside part 15" of the primary winding must be about twice the radial thickness of the outside part 15' when the average circumference of the inside part 15"' is half as large as the average circumference of the outside part 15'.

FIG. 2 also illustrates the corresponding build-up of the main insulation. The thickness of the insulation film, however, has been exaggerated so individual layers of plastic film 44 could be shown. The actual film thickness is typically only 0.05 mm. The insulation 40 illustrated in FIG. 2 is representative for a small toroidal transformer with prior art insulation. One wrap of 67% overlapping plastic film strip 44 is applied on the outside 15' of the primary winding, resulting in three layers of film strip 44 on the outside periphery, as shown in FIG. 2. The circumference of the inside part 15" in the center hole 12 of the primary winding, however, is only half as large as the circumference of the outside part 15' of the primary winding, so the total number of layers of film 44 on the inside of the center hole 12 in the primary winding 15 will be six. This is twice as much as is required by the safety code, and it clearly wastes space in the center hole of the toroidal transformer.

In a small toroidal transformer as illustrated in FIG. 2, the center hole 12 will have a diameter of about 30 mm, while the width of the plastic film strip 44 is about 13 mm. The plastic film strip 44 has some elasticity, but it is so wide relative to the curvature of the center hole 12 that it cannot conform exactly to the inner surface of the center hole 12. The actual space taken up by the plastic insulation in the center hole 12 of a small toroidal transformer 10, accordingly, will be much larger than the total net volume of film strip in the insulation. A substantial saving in center hole space accordingly would be gained if the amount of insulation in the center hole 12 could be reduced to the minimum required by the safety regulations without loss of the amount of insulation on the outside of the transformer, but this has not been possible with prior art insulation methods.

The excess build up of insulation 40 in the center hole of a toroidal transformer 10, however, can be avoided or greatly reduced by a new method for insulation of toroidal transformers according to the preferred embodiment described herein for the present invention. A preferred embodiment of this new insulation method is illustrated in FIGS. 4–6.

Figure 4:
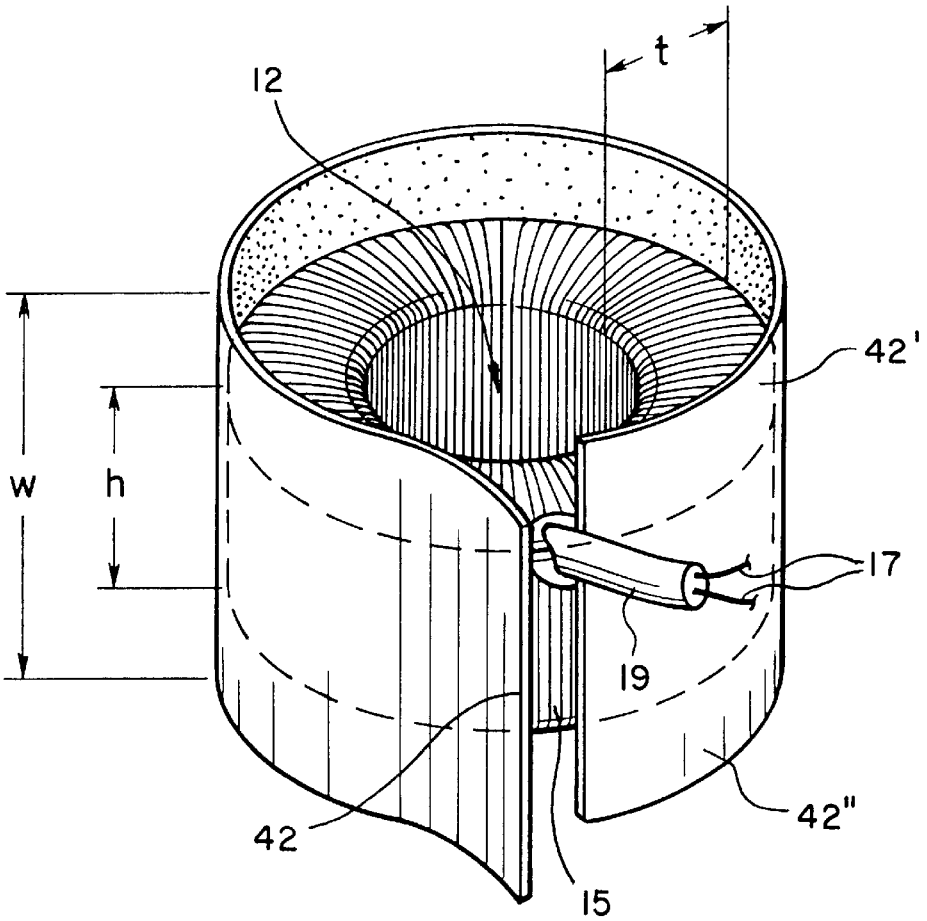
FIG. 4 is a perspective view of a primary winding in a toroidal transformer, illustrating a first step in a method for applying a space saving insulation to the transformer according to a preferred embodiment of the present invention.

The first step in the new insulation method is to wrap a sheet of plastic film 42 around the outer periphery of the primary winding 15, as shown in FIG. 4. The sheet of plastic film 42 must be wider than the lateral height (h) of the primary winding 15. The preferred width (w) is equal to or slightly smaller than the sum of the lateral height (h) and twice the radial extension (t) of the primary winding 15 ($w>h+2t$). The length of the plastic sheet 42 must be at least equal to the circumference of the primary winding 15, and in most cases the length should be sufficient to provide an overlap meeting the required standard for creep distance where the ends of the wide plastic sheet 42 meet. For easy application, it is preferable to use a plastic tape for the sheet 42, which has contact glue on the side contacting the primary winding 15, so it will stick to the primary winding 15. However, it is quite feasible to use plain plastic film and fasten it to the primary winding 15 by using short pieces of ordinary sticky plastic tape. The wrapping of the sheet 42 is preferably started adjacent to the insulating sleeve 19 covering the terminal wires 17 of the primary winding 15, as shown in FIG. 4, so the sleeve 19 can exit freely from the sheet 42.

Figure 5:
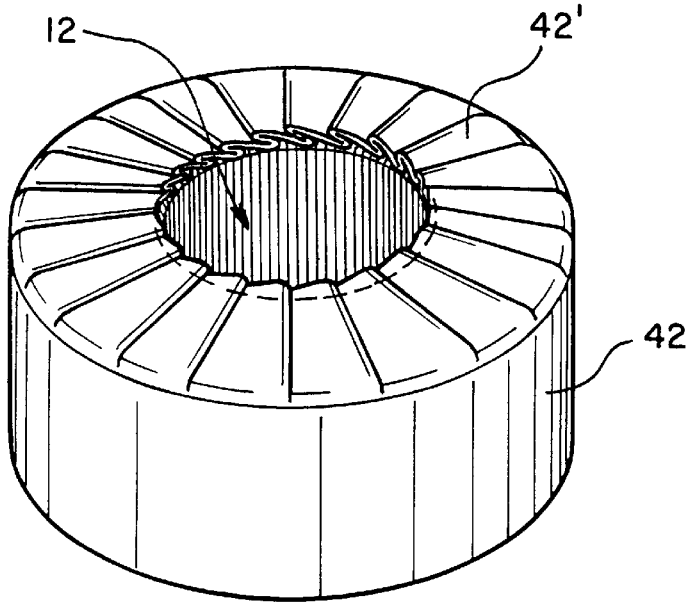
FIG. 5 is a perspective view of a primary winding in a toroidal transformer, illustrating a second step in a method for applying a space saving insulation to the transformer according to the preferred embodiment of the present invention.

Next, the top and bottom parts 42', 42" of the sheet 42 are folded down onto the top and bottom parts of the primary winding 15 as shown in FIG. 5. If plastic tape is used for the sheet 42, the contact glue keeps the sheet parts in place. Otherwise, small pieces of sticky tape are used to hold the sheet parts onto the top and bottom of the winding 15.

Figure 6:
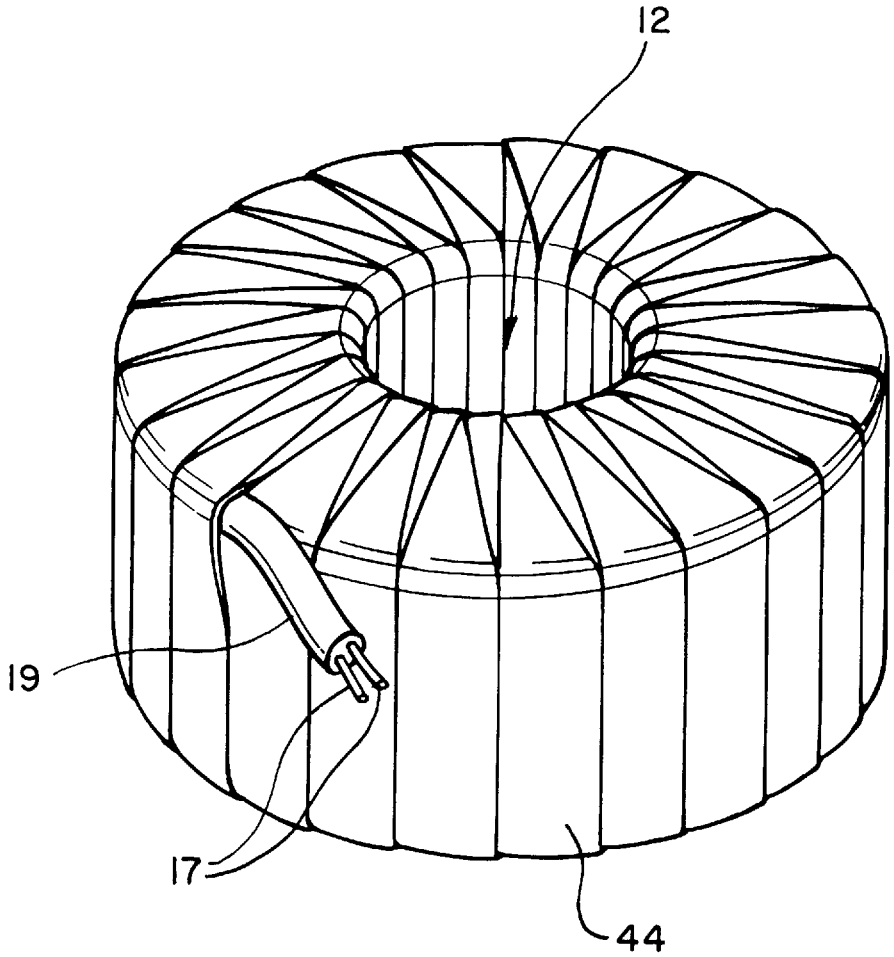
FIG. 6 is a perspective view of a primary winding in a toroidal transformer, illustrating a final step in a method for applying a main insulation to the transformer according to the preferred embodiment of the present invention.

Finally, the primary winding 15, with the sheet 42 fastened to the outside circumference and the top and bottom surfaces, is wrapped with narrow plastic strip 44 in a conventional toroidal insulating machine, as illustrated in FIG. 6. But in this case, only so much narrow strip 44 is used that the inside perimeter of the center hole 12 is covered with sufficient insulation to meet the safety requirements. The outside periphery and the top and bottom surfaces are already covered by the plastic sheet 42, so they have a sufficient total number of plastic film layers with only one wrap of 50% laterally overlapping strip.

Practical data for insulation for a toroidal transformer according to preferred embodiments of the invention, for instance, may be as follows:

| | |
|---|---|
| Transformer size > 100 VA: | 0.2 mm thick wide tape (42) plus one wrap of 67% laterally overlapping, narrow 0.05 mm strip (44) provides four layers of plastic film and 0.35 mm insulation thickness on the outside, and six layers and 0.3 mm insulation thickness on the inside of the primary winding 15. |
| Transformer size 25–100 VA: | 0.1 mm thick wide tape (42) plus one wrap of 50% laterally overlapping 0.05 mm thick strip (44) provides three layers of plastic film and 0.2 mm insulation thickness on the outside, and four layers and 0.2 mm insulation thickness on the inside of the primary winding 15. |
| Transformer size < 25 VA: | 0.05 mm thick wide tape (42) plus one wrap of 50% laterally overlapping 0.05 mm thick strip (44) provides three layers of plastic film and 0.15 mm insulation thickness on the outside, and four layers and 0.2 mm thick insulation on the inside of the primary winding 15. |

Figure 3:
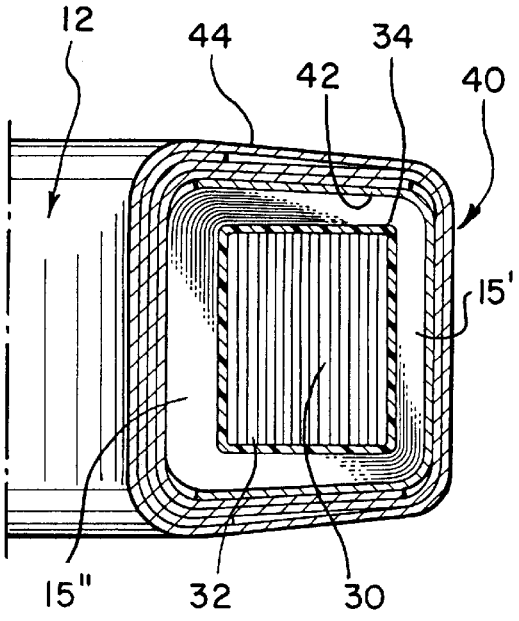
FIG. 3 is a sectional view, taken along line 3—3 in FIG. 1, and is similar to FIG. 2, but illustrating a space saving insulation for a primary winding in a toroidal power transformer according to a preferred embodiment of the present invention with the same exaggeration of the insulation thickness as in FIG. 2.

FIG. 3 illustrates the insulation build up in a small transformer (<25 VA) with main insulation 40 according to a preferred embodiment of the present invention. FIG. 3 corresponds directly to FIG. 2, which illustrates a prior art insulation in a small transformer, and the insulation thickness is again exaggerated to allow illustration of separate layers of plastic film. A comparison of FIGS. 2 and 3 show clearly how the preferred embodiment of the invention saves space in the center hole 12: There are only four layers of plastic strip inside the center hole 12 in the insulation for the transformer according to the preferred embodiments of the invention, while there are six layers of plastic film inside the center hole 12 in the insulation for the prior art transformer; but in both cases there are three layers of plastic film on the outside periphery of the primary winding 15, as required by the safety standards. For larger transformers, the difference in insulation volume in the center hole 12 is still larger, as will be evident from the description above.

The diameter of the residual center hole 12 is a critical parameter in the design and manufacture of toroidal transformers, because it limits the size of the winding magazine that can be used. For large transformers with large diameter secondary wire, the minimum center hole diameter may be 70 mm or larger. For very small toroidal transformers the minimum center hole diameter will be about 25 mm when the smallest winding heads for very thin wire of a winging magazine is used. Hand winding requires a minimum center hole diameter of about 15 mm to allow passage of shuttles for wire and/or insulating strip.

Those skilled in the art will realize that both the size and the cost of a toroidal transformer are affected by the core diameter, and that the core diameter is limited by the required minimum center hole 12 diameter of the finished transformer. A reduction in the volume of insulation in the center hole 12 of a toroidal transformer as described for the preferred embodiments of the present invention thus is important for the economy of toroidal transformer manufacture, and for the users of toroidal transformers in applications where size is critical. In some cases, the savings in insulation build-up in the center hole of a small toroidal transformer made possible by the preferred embodiment of the present invention may be sufficient to allow machine winding and machine insulation in cases where it was previously necessary to use much more costly hand winding and hand insulation in the final steps of the transformer manufacture.

It is important to note that the above-described preferred embodiments of the present invention provide the space saving transformer insulation without any disadvantage in cost over prior art transformer insulation methods. The transformer insulation method according to the invention may, in fact, often be less expensive than prior art transformer insulation methods even when it does not make hand winding and hand insulation unnecessary. Application of the outer wide sheet or tape is an extremely fast and easy process, and less time and material are used by the method according to the invention for the step involving conventional wrapping with a narrow strip of The description above and the accompanying drawings illustrate details of preferred embodiments of the invention, but the invention is not limited to what has been shown above. For example, the separate insulation 42 or film sheet for the outside perimeter of a winding 15 need not cover the full radial extension of the top and bottom surfaces of the winding 15 as described above. It is sufficient that this separate insulation 42 be wide enough to cover those parts of the winding 15 that are not covered sufficiently by the wrapping with a narrow strip 44 alone to meet safety requirements. The minimum width required for the extra outside insulation 42 thus will vary from case to case, but it is on the other hand no disadvantage to use a wider outer insulation 42, as long as this insulation is not so wide that it enter into the center hole 12. It is also not necessary to use plastic film, as described, or to use the same material in the wide film sheet of insulation 42 as in the narrow strip of insulation 44, as long as the entire insulation meets the performance requirements set forth by international standards organizations. In accordance with the above-described preferred embodiments of the invention, the method and transformer combines wraps with a narrow strip of insulation 44 covering all parts of a winding 15 with additional insulation 42 for the outside perimeter of the winding in order to avoid build up of more insulation material in the center hole 12 of a toroidal transformer than necessary for electrical safety reasons.

It will also be evident to those skilled in the art that as an alternative embodiment to those above described preferred embodiments of the invention, the method and transformer can provide wrapping of the narrow strip of insulation 44 first, and then provide the additional separate film sheet of insulation 42 on top of the narrow strip of insulation 44 and still meet the safety requirements.

It will be evident to those skilled in the art that the transformer insulation method according to the present invention can be used for other than the main insulation between a primary winding 15 and a secondary winding 25 in toroidal power transformers. The invention is applicable for insulation between separate primary windings in transformers with multiple primaries, for insulation between separate secondary windings when required in transformers with multiple secondary windings, for the outer insulation of a toroidal transformer, and for insulation of windings in toroidal magnetic devices other than power transformers. In many cases, the insulation requirements may be less severe than for the main insulation in a toroidal power transformer as described above. However, this does not alter the basic scope of the invention, which is to combine wraps with narrow strip of insulation 44 covering all parts of a winding 15 with additional insulation 42 for the outside perimeter of the winding in order to avoid build up of more insulation material in the center hole 12 of a toroidal transformer than necessary for electrical safety reasons. The type and thickness of the two insulation parts may be different from the examples given above without falling outside the scope of the invention.

Although preferred embodiments of the invention have been shown and described, it will be appreciated by those skilled in the art that changes may be made in these embodiments without departing from the principles and spirit of the invention, the scope of which is defined in the appended claims and their equivalents.

What is claimed is:

1. A method for insulating a winding on a toroidal transformer comprising the steps of:

providing a toroidal transformer with a winding having a center hole, an outer periphery, an axial extension, and upper and lower surfaces with radial extensions;

providing a sheet of insulating material having edges defining a width larger than said axial extension;

wrapping said sheet of insulating material along said outer periphery; folding the edges of said sheet onto said upper and lower surfaces;

providing a narrow strip of insulating material; and winding said narrow strip of insulating material through said center hole to cover said winding and said sheet of insulating material.

2. A method for insulating a winding on a toroidal transformer according to claim 1, wherein said sheet of insulating material is a tape with contact glue on the side contacting the winding.

3. A method for insulating a winding on a toroidal transformer according to claim 1, wherein the width of said sheet of insulating material is substantially equal to the sum of the dimensions of said axial extension, said upper radial extension, and said lower radial extension.

4. A method for insulating a winding on a toroidal transformer according to claim 1, wherein said narrow strip of insulating material is wound to form a double layer of narrow strip along said outer periphery.

5. A toroidal transformer comprising:

(a) a winding with a center hole, an outer periphery, an axial extension, and upper and lower radial extensions between said outer periphery and said center hole; and (b) electrical insulation applied on said winding, wherein said insulation includes (i) a sheet of insulating material having edges defining a width larger than said axial extension wrapped around said outer periphery and with edges folded onto said upper and lower radial extensions and (ii) a narrow strip of insulating material wrapped through said center hole and covering said winding and said sheet of insulating material.

6. A toroidal transformer according to claim 5, wherein said narrow strip of insulating material forms multiple layers of strip on the outer periphery of said winding and said sheet of insulating material.

7. A toroidal transformer according to claim 5, wherein said sheet of insulating material has a width substantially equal to the sum of said axial extension and said upper radial extension and said lower radial extension.

8. A toroidal transformer comprising:

(a) a winding with a center hole, an outer periphery, an axial extension, and upper and lower redial extension between said out periphery and said center hole; and (b) electrical insulation applied on said winding, wherein said insulating includes (i) a narrow strip of insulating material wrapped through said center hole and covering said winding, and (ii) a sheet of insulating material having edges defining a width larger than said axial extension wrapped around said outer periphery outside said narrow strip of wrapped insulation and with edges folded onto said upper and lower radial extensions.

* * * * *

UNITED STATES PATENT AND TRADEMARK OFFICE

CERTIFICATE OF CORRECTION

PATENT NO.: 5,838,220
DATED : November 17, 1998
INVENTOR(S): Christer Hagberg

It is certified that error appears in the above-identified patent and that said Letters Patent is hereby corrected as shown below:

Column 5, line 45, change "$(w > h + 2t)$" to --$(w \leq h + 2t)$--;

Column 7, line 25, after "narrow strip of" insert --insulation--.

Signed and Sealed this

Fourteenth Day of September, 1999

*Attest:*

Q. TODD DICKINSON

*Attesting Officer*

*Acting Commissioner of Patents and Trademarks*